US006211131B1

(12) United States Patent
Kaaret et al.

(10) Patent No.: US 6,211,131 B1
(45) **Date of Patent: *Apr. 3, 2001**

(54) SEQUESTERANTS AS HYPOCHLORITE BLEACH ENHANCERS

(75) Inventors: Thomas W. Kaaret, Alamo; William L. Smith, Pleasanton, both of CA (US)

(73) Assignee: The Clorox Company, Oakland, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/970,052

(22) Filed: Nov. 13, 1997

Related U.S. Application Data

(63) Continuation-in-part of application No. 08/642,981, filed on May 10, 1996.

(51) Int. Cl.[7] ..... C11D 7/54

(52) U.S. Cl. ..... 510/318; 510/303; 510/380; 8/108.1; 252/187.25; 252/187.26

(58) Field of Search ..... 8/108.1, 109; 252/187.24, 252/187.26, 187.25; 510/302, 303, 318, 361, 380, 434

(56) References Cited

U.S. PATENT DOCUMENTS

| | | | | |
|---|---|---|---|---|
| 2,244,703 | * | 6/1941 | Hubbuch | 260/84 |
| 3,655,566 | | 4/1972 | Robinson et al. | 510/513 |

(List continued on next page.)

FOREIGN PATENT DOCUMENTS

| | | |
|---|---|---|
| 29 03 980 A1 | 8/1980 | (DE) . |
| 0 311 175 A2 | 4/1989 | (EP) . |
| 0 653 482 A1 | 5/1995 | (EP) . |
| 0 653 483 A1 | 5/1995 | (EP) . |
| 0 743 280 A1 | 11/1996 | (EP) . |

(List continued on next page.)

OTHER PUBLICATIONS

Acusol®, Detergent Polymers, Rohm and Haas, 1995.
SOKALAN®, Polymeric Dispersing Agents, BASF, Website, Apr. 1999.
BASF Performance Chemicals Product Brochure (pp. 1–15), 1995 (no month available).

*Primary Examiner*—Caroline D. Liott
(74) *Attorney, Agent, or Firm*—Burns, Doane, Swecker & Mathis, L.L.P.

(57) ABSTRACT

Sequestering agents for use as a whitening and fabric strength enhancer for aqueous hypochlorite bleach compositions are provided. It was found that the sequesterants when used with hypochlorite in the presence of soluble heavy metal ions, particularly iron and manganese ions, provide significantly improved whitening and fabric protection. Most preferably, the sequesterants are selected from polyacrylic acid, a polyacrylic acid derivative, a copolymer of acrylic acid or methacrylic acid and a comonomer which is maleic acid or maleic anhydride and mixtures thereof. In one aspect, the sequesterants are employed in a method for laundering fabrics that includes the steps of: a) providing, in a wash liquor containing (i) at least about 40 ppb of iron cations or (ii) at least about 10 ppb of manganese cations, or (iii) the cations of both (i) and (ii), and a fabric piece; and b) adding either prior to, contemporaneously with, or after, the step of providing of said fabric piece to said wash liquor a hypochlorite composition which comprises one or more of said sequesterants. Preferably the sequesterant includes at least 0.1 ppm by weight of said wash liquor and the stable hypochlorite composition is an alkali metal hypochlorite and said sequesterant has a molecular weight of between about 500 and 500,000 daltons.

16 Claims, 4 Drawing Sheets

U.S. PATENT DOCUMENTS

| | | | | |
|---|---|---|---|---|
| 3,666,680 | | 5/1972 | Briggs | 510/303 |
| 3,764,559 | | 10/1973 | Mizuno et al. | 510/230 |
| 3,878,037 | | 4/1975 | Hansen et al. | 252/187.26 |
| 3,887,509 | * | 6/1975 | Bolstad et al. | 260/29.1 |
| 4,147,650 | | 4/1979 | Sabatelli et al. | 510/223 |
| 4,203,858 | | 5/1980 | Chakrabarti | 510/230 |
| 4,228,048 | | 10/1980 | Tesdahl | 510/218 |
| 4,246,129 | | 1/1981 | Kacher | 510/192 |
| 4,283,300 | | 8/1981 | Kurtz | 510/193 |
| 4,331,572 | * | 5/1982 | Tomasi et al. | 524/238 |
| 4,386,120 | * | 5/1983 | Sato et al. | 427/213 |
| 4,420,412 | | 12/1983 | Wong | 510/193 |
| 4,428,872 | | 1/1984 | Callicott | 510/193 |
| 4,554,091 | | 11/1985 | Jones et al. | 252/187.25 |
| 4,606,842 | | 8/1986 | Keyes et al. | 510/182 |
| 4,681,696 | | 7/1987 | Bruegge et al. | 252/187.26 |
| 4,708,816 | | 11/1987 | Chang et al. | 252/186.25 |
| 4,725,378 | | 2/1988 | Krawczak | 510/302 |
| 4,728,455 | | 3/1988 | Rerek | 8/111 |
| 4,755,354 | | 7/1988 | Trinh et al. | 422/37 |
| 4,839,077 | | 6/1989 | Cramer et al. | 510/373 |
| 4,852,990 | * | 8/1989 | Patterson | 8/108.1 |
| 4,857,226 | * | 8/1989 | Drapier et al. | 510/223 |
| 4,867,896 | | 9/1989 | Elliott et al. | 510/223 |
| 4,929,383 | | 5/1990 | Haendler | 252/187.26 |
| 4,931,207 | | 6/1990 | Cramer et al. | 252/187.26 |
| 4,952,333 | | 8/1990 | Cramer | 252/187.24 |
| 4,992,195 | | 2/1991 | Dolan et al. | 510/221 |
| 5,055,219 | | 10/1991 | Smith | 510/195 |
| 5,080,826 | | 1/1992 | Colborn et al. | 252/187.25 |
| 5,104,571 | | 4/1992 | Cramer | 252/187.24 |
| 5,126,069 | | 6/1992 | Kud et al. | 510/476 |
| 5,196,139 | * | 3/1993 | Moschner | 8/101 |
| 5,205,953 | * | 4/1993 | Dixit | 510/223 |
| 5,286,810 | | 2/1994 | Wood | 525/421 |
| 5,296,239 | | 3/1994 | Colery et al. | 510/303 |
| 5,348,682 | * | 9/1994 | Finley et al. | 252/186.36 |
| 5,478,356 | | 12/1995 | Kaaret | 510/226 |
| 5,531,915 | | 7/1996 | Perkins et al. | 510/294 |
| 5,733,857 | * | 3/1998 | Yamaguchi et al. | 510/361 |
| 5,747,440 | * | 5/1998 | Kellett et al. | 510/276 |

FOREIGN PATENT DOCUMENTS

| | | |
|---|---|---|
| 0 743 391 A1 | 11/1996 | (EP) . |
| 0 781 840 A1 | 7/1997 | (EP) . |
| 64-56798 | 3/1989 | (JP) . |
| 7-331294 | 12/1995 | (JP) . |
| WO 88/05461 | 7/1988 | (WO) . |
| WO 94/07987 | 4/1994 | (WO) . |
| WO 96/00188 | 1/1996 | (WO) . |

* cited by examiner

SEQUESTERANTS AS HYPOCHLORITE BLEACH ENHANCERS

This is a continuation-in-part application of Ser. No. 08/642,981 filed on May 10, 1996.

FIELD OF THE INVENTION

The present invention generally relates to stable liquid bleach compositions useful in treating fabrics and particularly relates to hypochlorite bleach-containing aqueous cleaning compositions comprising sequestering agents as whitening and fabric strength enhancers.

BACKGROUND OF THE INVENTION

The quality of raw water and finished (treated) water varies considerably throughout the world. For instance, the types and levels of trace metals found in water from household taps can vary significantly from one country to another. The presence of certain trace metals often reduces the effectiveness of laundering aids and causes fabric damage.

Hypochlorite liquid bleaches have found wide commercial acceptance and are commonly used in a variety of household cleaning and laundering products. The effectiveness of hypochlorite bleach compositions is usually not adversely affected by trace metals found in water used in laundering. However, it has been found that the presence of iron and manganese metal ions in water used in laundering causes fabrics to yellow and deteriorate. This phenomenon is particularly pronounced when the bleaching composition is not used in combination with a laundry detergent.

In WO 96/00188 it was speculated that the presence of metal impurities in the washing environment catalyzed the attack of hypochlorous acid on fabrics with the generation of yellow oxidized species. It was believed that the metal ions are adsorbed on fabrics as colored species and catalyzed the degradation of the brighteners absorbed on fabrics. Furthermore, it was said that the metal ions stabilized colored pigments of enzymatic stains, such as blood and grass, that caused such stains to "set". Finally, it was said that the metal ions catalyzed the depolymerization of cotton fibers which leads to reduced tensile strength of the fabrics thereby reducing fabric resistance.

To counter the deleterious effects caused by the presence of heavy metal ions in hypochlorite-containing cleaning compositions, the art has suggested the employment of various agents to improve fabric whiteness and integrity. These agents, for example, include periodate, silicates, and pyridine with carboxylic acid substituents. See, for example, WO 96/00188, and EP 06/53482, and EP 0653483.

While some of these complexing agents have demonstrated hypochlorite bleach enhancement in terms of fabric whitening and safety, they are not satisfactory for a number of reasons. First, these prior art complexing agents are expensive to use. Second, some of these complexing agents do not mitigate the dingying effect of hypochlorite on fabrics washed in water containing significant levels of iron and/or manganese ions.

SUMMARY OF THE INVENTION

The present invention is based in part on the discovery of a series of sequestering agents for use as a whitening and fabric strength enhancer for aqueous hypochlorite bleach compositions. It was found that the sequesterants when used with hypochlorite in the presence of heavy metal ions, particularly iron and/or manganese ions, provide significantly improved whitening. It is expected that the sequesterants will also provide fabric protection. The sequesterants comprise polycarboxylates. Most preferably, the sequesterant is selected from polyacrylic acid, a polyacrylic acid derivative, a copolymer of acrylic acid or methacrylic acid and a comonomer which is maleic acid or maleic anhydride and mixtures thereof. Adjuvants such as sodium hydroxide, sodium carbonate, fluorescent whiting agents, fragrances dyes, and thickening agents can also be employed in conjunction with the sequesterants.

In one aspect, the invention is directed to an hypochlorite bleach composition which consists essentially of an alkali metal hypochlorite and an effective amount of a polycarboxylate sequesterant. Preferred sequesterants include, for example, polyacrylic acid, polyacrylic acid derivatives, copolymers of acrylic acid or methacrylic acid and a comonomer which is maleic acid or maleic anhydride, and mixtures thereof.

In another aspect, the invention is directed to a method for laundering fabrics with improved whitening and reduced fabric damage, said method including the steps of:

a) providing, in a wash liquor containing (i) at least about 40 ppb of iron cations or (ii) at least about 10 ppb of manganese cations, or (iii) the cations of both (i) and (ii), and a fabric piece; and b) adding prior to, contemporaneously with, or after, the step of providing of said fabric piece to said wash liquor a hypochlorite composition which comprises an effective bleaching amount of an alkali metal hypochlorite and an effective amount of a polycarboxylate sequesterant to mitigate the attack of said cations on said fabrics wherein the sequesterant is a polymer that is selected from the group consisting of polyacrylic acid, a polyacrylic acid derivative, a copolymer of acrylic acid or methacrylic acid and a comonomer which is maleic acid or maleic anhydride and mixtures thereof.

In a further aspect, the invention is directed to a wash liquor containing (i) at least about 40 ppb of iron cations, or (ii) at least about 10 ppb of manganese cations, or (iii) the cations of both (i) and (ii), said wash liquor further including:

a) a fabric piece which has a tendency to be attacked by said cations in said wash liquor, and b) a hypochlorite composition which includes an effective amount of alkali metal hypochlorite and an effective amount of polycarboxylate sequesterant to mitigate the attack of said cations on said fabric piece.

Preferably, the sequesterant comprises at least about 0.1 ppm by weight of said wash liquor. Preferably, the hypochlorite composition is an alkali metal hypochlorite and said sequesterant has a molecular weight of between about 500 and 500,000 daltons, and preferably from about 3,000 to 70,000 daltons.

The hypochlorite bleach composition of the present is stable and typically, the amount of alkali metal hypochlorite remaining will range from about 90% to about 95% of the original concentration even after storage at ambient temperature for about 12 months or longer.

DESCRIPTION OF THE PREFERRED EMBODIMENTS

Figure 1:
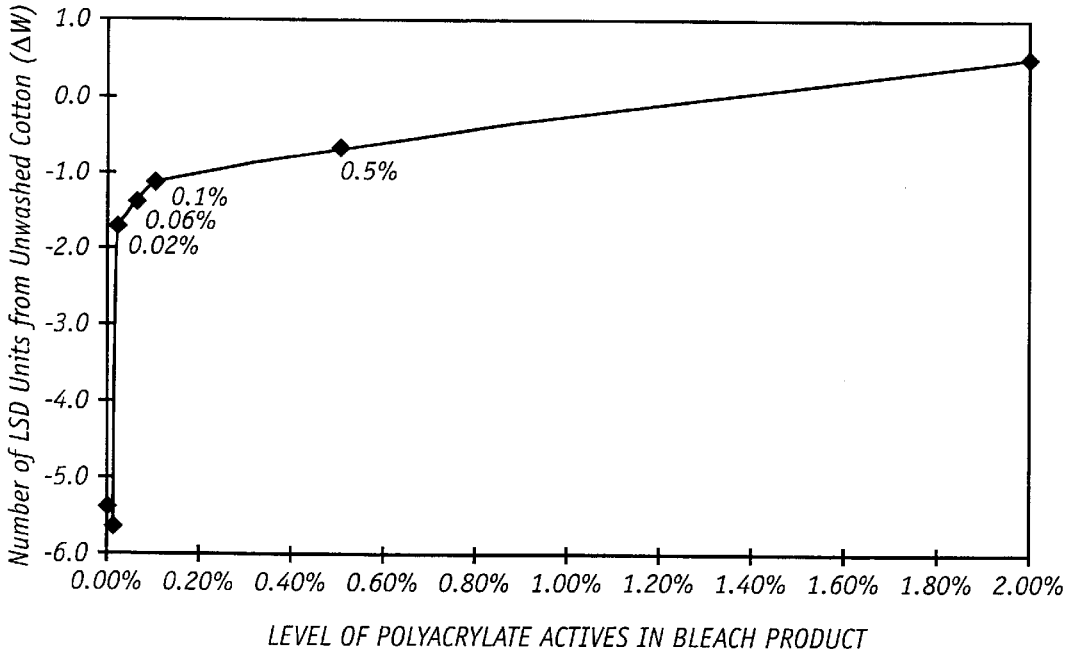
FIGS. 1 and 2 are graphs showing the effect of polyacrylate level on yellowing of cotton fabric by hypochlorite bleaching compositions in washes containing soil and metals.

Sequestering agents of the present invention comprise polycarboxylates which are polymers wherein one or more of the repeating units comprise the substituent —COOR, wherein R is hydrogen, alkali metal ion, alkali earth metal ion, ammonium ion or tetraalkylammonium, wherein the alkyl has 1 to 4 carbons.

Preferably, sequestering agents are selected from the group consisting of polyacrylic acid, a polyacrylic acid derivative, or a copolymer of acrylic acid or methacrylic acid and a comonomer which is maleic acid or maleic anhydride. By "polyacrylic acid derivative" is meant copolymers derived from acrylic monomers and non-acrylic monomers. Acrylic monomers generally refer to esters of acrylic acid and methacrylic acid as well as those of other α-substituted acrylic acids (e.g., α-chloroacrylic, and α-ethylacrylic acids). Preferred acrylic monomers include, for example, acrylic acid and methacrylic acid. Suitable non-acrylic acid monomers include, for example, ethylene and propylene.

Other suitable polycarboxylate sequestering agents include, for example, polymethacrylate (DAXAD 30,35, 37™ from W. R. Grace & Co. and ALCOSPERSE 124™ from ALCO Chemical), acrylic acid/methacrylic acid (SOKOLAN CP 135™ from BASF Corp.), an oxidized ethylene/acrylic acid, carboxylated vinyl acetate (DARATAK 78L™ from W. R. Grace), vinyl acetate/crotonic acid (LUVISET CA66™ from BASF Corp.), vinyl acetate/vinyl propionate/crontonic (LUVISET CAP™ by BASF Corp.), vinyl acetate/vinyl neodecanoate/crontonic acid (Resyn 28-2930(by National Starch Co.), vinyl acetate/methacryloxy 1-benzophenone/crontonic acid (RESYN 28-3307™ from National Starch Co.), acrylic acid/methylethyl acrylate, ethylene/maleic acid (EMA™ from Monsanto Co.), poly(isobutylene/maleic acid) (DAXAD 31™ from W. R. Grace & Co.), maleic acid/vinyl acetate (LYTRON X 886™ from Monsanto Co.), poly(methyl vinyl ether/maleic acid) (SOKALAN CP2™ from BASF Corp.), poly(styrene/maleic anhydride) and mixtures thereof. Preferably the average molecular weight of the polycarboxylate polymer sequestering agent is between about 500 to 500,000 daltons and preferably ranges from about 1,000 to about 200,000 daltons, more preferably from about 3,000 to about 70,000 daltons.

Most preferably the sequestering agent is selected from polyacrylic acid, a polyacrylic acid derivative, a copolymer of acrylic acid or methacrylic acid and a comonomer which is maleic acid or maleic anhydride and mixtures thereof. Although the scope of the invention is not to be limited by any particularly theory, it is believed that hypochlorite bleach accelerates a chemical reaction analogous to the one that forms rust when iron ions are present. It is believed that the carboxyl groups in these polymer sequestering agents are able to (1) shield the Mn and Fe cations from hypochlorite ions, and/or (2) disperse the oxidized forms of the metals in solution and thereby prevent them from depositing onto fabrics.

It has been demonstrated that the yellowing effect of hypochlorite and the accompanying fabric damage occur when the level of iron ions in the wash liquor is about 60 ppb or higher or when the level of manganese ions is about 20 ppb or higher. It is expected that the yellow effect and fabric damage will occur when the iron ion concentration is about 40–50 ppb or the manganese ion concentration is about 10–15 ppb. It is expected that the sequestering agents of the present invention will be effective when the wash liquor comprises about 40 ppb or higher of iron ions and/or about 10 ppb or higher of manganese ions. It has been further demonstrated that ferrous ions cause approximately the same level of yellowing and damage to fabric as ferric ions, therefore, iron ions shall refer to either ferrous ions, ferric ions, or a mixture of both. Manganese ions are generally Mn(II). The concentration of sequestering agents should be sufficient to mitigate the dingying effect of hypochlorite on fabric, particularly white fabric, and to prevent or reduce the level of fabric damage when the fabric is washed in water containing iron and/or manganese ions present at these concentration level(s).

Sequestering agents of the present invention are particularly suited when the wash liquor contains both iron and manganese ions. Preferably, the concentration of the sequestering agents in the wash liquor is from about 0.1 ppm to about 200 ppm, more preferably from about 0.2 ppm to about 80 ppm and most preferably about 0.4 ppm to about 20 ppm all measured on a weight basis. A higher sequestering agent concentration is preferably used when higher level(s) of iron and/or manganese ions are present. Thus, the amount of sequestering agent employed in the wash liquor can be formulated in accordance with the level of iron and/or manganese ions found in the water source of a particular location or region. Furthermore, the sequestering agent can be added as a separate additive to the wash liquor comprising a hypochlorite bleach. Preferably hypochlorite bleach compositions are formulated to include requisite amounts of the sequestering agent.

Sequestering agents of the present invention can be employed in aqueous hypochlorite bleach compositions containing an alkali metal hypochlorite, most preferably sodium hypochlorite. Hypochlorite bleaching compositions are described, for instance, in U.S. Pat. No. 5,080,826 which is incorporated herein. The hypochlorite bleach composition (without said sequestering agents) is typically commercially available as an aqueous solution comprising about a 1-15%, preferably about a 48%, solution of sodium hypochlorite in water, with various amounts of sodium hydroxide, sodium chloride and other by-products of the manufacturing process present. (All percentages herein are on a weight basis unless stated otherwise.) When the hypochlorite bleach composition is formulated with a sequestering agent, the composition preferably comprises about 0.0015% to about 5%, more preferably about 0.0015% to about 1%, and most preferably about 0.0025% to about 0.5% of said sequestering agent.

The hypochlorite bleach composition may, if desired, also contain additional components such as buffers, primary cleansing agents (surfactants), builders, fluorescent whitening agents, fragrances, pigments, dyes and thickening agents. Buffers preferably comprise one or more of a pH adjusting agent effective to adjust or to maintain the pH of a solution (e.g., wash liquor) in which the hypochlorite bleach composition is added to a pH greater than about 10. Suitable pH adjusting agents, are well known to the art and include, for example, carbonates, borates, phosphates, silicates, and bicarbonates. Although one or more adjuvants may be incorporated, the hypochlorite bleach composition with the sequestering agent is particularly suited when the wash liquor does not include any laundry detergent such as, for example, TIDE™ by Procter & Gamble, Cincinnati Ohio, and WISK™ and SURF™ by Lever Brothers, N.Y., N.Y. By "laundry detergent" is meant a composition that contains both surfactants and builders and preferably various adjuvant components.

Representative fluorescent whitening agents include naphtholtriazol stilbene and distyryl biphenyl fluorescent whitening agents sold by the Ciba-Geigy Corporation under the names TINOPAL® RBS and TINOPAL® CBS-X, respectively, and the stilbene materials also marketed by Ciba-Geigy under the name TINOPAL® 5BMX. Other useful whiteners are disclosed in U.S. Pat. No. 3,393,153 and further useful whiteners are disclosed in ASTM publication D-553A, List of Fluorescent Whitening Agents for the Soap and Detergent Industry, which disclosures are incorporated herein.

Representative surfactants include conventional anionic, cationic, nonionic, ampholytic and zwitterionic surfactant materials as are described in the art. Examples of suitable surfactants for use in these formulations may be found in Kirk-Othmer, Encyclopedia of Chemical Technology, 3rd Edition, volume 22, pages 247–387 (1983) and McCutcheon's Detergents and Emulsifiers, North American Edition (1983). These two disclosures are incorporated herein by reference. One generally preferred group of surfactants are the nonionic surfactants such as are described at pages 360–377 of Kirk-Othmer. Nonionic materials include alcohol ethoxylates, alkyl phenol ethoxylates, carboxylic acid esters, glycerol esters, polyoxyethylene esters, anhydrosorbitol esters, ethoxylated anhydrosorbitol esters, ethoxylates of natural fats, oils and waxes, glycol esters of fatty acids, carboxylic amides, diethanolamine condensates, monoalkanolamine condensates, polyoxyethylene fatty acid amides, polyalkylene oxide block copolymers, poly(oxyethylene-co-oxypropylene) nonionic surfactants and the like. A wide range of such materials are available commercially, including the Shell Chemical NEODOLS®, the Union Carbide TERGITOLS®, the ICI TWEEN® series, and the SPAN® series and the like. Preferably, surfactants range from 0 to about 5 % by weight of the inventive composition.

Fragrances are usually blends of volatile oils that are composed of organic compounds such as esters, aldehydes, ketones or mixtures thereof. Such fragrances are usually proprietary materials commercially available from such manufacturers as Quest, International Flavors and Fragrances, Givaudan and Firmenich, Inc. Examples of fragrances which may be suitable for use in the present invention may be found in Laufer et al., U.S. Pat. No. 3,876,551, and Boden et al, U.S. Pat. No. 4,390,448, which are incorporated herein. Stable fragranced hypochlorite bleaching compositions are described, for example, in U.S. Patent No. 5,080,826.

Fillers or bulking agents may also be included in the bleaching compositions of the invention. A preferred filler salt is an alkali metal sulfate or an alkali chloride, such as potassium or sodium sulfate, the latter being especially preferred.

EXPERIMENTAL

Ex. 1. Sequestering Agent as a Whitening Enhancer

To demonstrate the effectiveness of the inventive sequestering agents, unbrightened, white cotton swatches were prewashed for 20 minutes in water containing 900 ppb Fe(III) and 300 ppb Mn(II) and various NaOCl bleach formulations in a U.S. Testing TERG-O-TOMETER bath that was maintained at a temperature of about 100° F. (37.8° C.). The wash liquor comprised water with a hardness of 100 ppm of 3:1 (Ca:Mg) hardness and 1.5 Mm bicarbonate. (These levels are referred to herein as the baseline hardness and bicarbonate levels.) Enough of each bleach formulation (or bleach product) was added to the wash liquor to provide 200 ppm available chlorine. The enhancer refers to the additive (wt %) present in the bleach formulation prior to dilution in the wash liquor. Whiteness was determined by making pre-wash and post-wash reflectance measurements on a Hunter Colorimeter without an ultraviolet ("uv") filter. ΔW is a standard measure of whiteness derived from the colorimeter. The more positive the number, the whiter the material. The results are tabulated in Tables 1 and 2.

TABLE 1

| Bleach | Enhancer in Product | ΔW |
|---|---|---|
| 1. A | None | −13.18 |
| 2. B | None | −11.15 |
| 3. C | None | −5.76 |
| 4. B | 4.0% NaOH | −10.44 |
| 5. B | 1.8% $Na_2CO_3$ | −8.18 |
| 6. B | 4.0% NaOH + 1.8% $Na_2CO_3$ | −10.33 |
| 7. B | 4.0% NaOH + 1.8% $Na_2CO_3$ + 1% Dipicolinic acid | −10.98 |
| 8. B | 1% KI | −3.78 |
| 9. B | 1% Picolinic Acid N-oxide | −9.83 |
| 10. B | 1% Trisodium Phosphate | −2.93 |
| LSD | | 2.39 |

TABLE 2

| Bleach | Enhancer in Product | ΔW |
|---|---|---|
| 1. B | None | −13.70 |
| 2. B | 2% of actives of SOKOLAN CP7 ™ | −1.15 |
| 3. B | 2% of actives of ACUSOL 445N ™ | −0.88 |
| 4. B | 2% of actives of ACUSOL 479N ™ | −2.79 |
| 5. B | 2% of actives of ACUSOL 505N ™ | −3.21 |
| 6. C | None | −2.55 |
| LSD | | 3.09 |

Bleach "A" comprises aqueous 5.25% NaOCl solution which is available as CLOROX ® LIQUID BLEACH from Clorox Co., Oakland, Calif.
Bleach "B" comprises aqueous 5.25% NaOCl solution with 0.65% NaOH.
Bleach "C" comprises 5.8% NaOCl, 5.37% NaCl, 1.38% NaOH, 1.28% $Na_2CO_3$, 0.47% $NaClO_3$, and 0.86% $Na_2O(SiO_2)_{2.4}$.
ACUSOL 445N ™ is polyacrylic acid, Na salt (MW 4,500), ACUSOL 479N ™ is acrylic acid/maleic acid copolymer, Na salt (MW 70,000), ACUSOL 505N ™ is acrylic acid/maleic acid copolymer, Na salt (MW 40,000) all from Rohm and Haas Co., SOKALAN CP7 ™ is acrylic acid/maleic acid copolymer, Na salt (MW 50,000) from BASF Corp.
LSD is the least significant difference at a 95% confidence level.

The results in Table 1 demonstrate that formulation 3 which contains silicates reduced the adverse effects of hypochlorite slightly whereas increasing the alkalinity, in formulations 4–6, or adding dipicolinic acid or picolinic acid N-oxide, in formulations 7 and 9, respectively, had little effect. Increased alkalinity does improve the shelf stability of hypochlorite in the presence of the polycarboxylate sequestering agent, thus, preferably, the pH of hypochlorite bleaching compositions comprising the sequestering agents should have a pH of at least about 10. Formulations 8 and 10 reduced the adverse effects of hypochlorite significantly. Finally, the results in Table 2 further demonstrate that the presence of the inventive sequestering agents significantly reduced the deleterious effects of hypochlorite bleach.

Examples 2–4

For Examples 2–4, unbrightened, white cotton swatches were washed in a commercial washer for 20 minutes in warm water (about 88° F. (31° C.)–105° F. (40.6° C.)) having the baseline hardness and bicarbonate levels with no detergent present. The amount of each bleach product provided 200 ppm available chlorine. All samples were also rinsed at 68 ° F. (20° C.) under the normal U.S. rinse cycles comprising presoak, agitation, and drainage. Thereafter, the fabric was dried for 30 minutes in a dryer. Metals levels were 900 ppb Fe(m) and 300 ppb Mn(II). A heavily soiled pillow case was used to add soil. The polyacrylate sequestering agent used was ACUSOL 445 N™ (average MW 4500 daltons). Whiteness was determined by making pre-wash and post-wash reflectance measurements on a Hunter Colorimeter without a uv filter. In each case, the ΔW and number of LSD units from unwashed cotton fabric were measured.

For Examples 2–7 herein, Bleach Product "A" comprised an aqueous 5.25% NaOCl solution available as CLOROX® LIQUID BLEACH™ from Clorox Co., Oakland, Calif., and Bleach Product "B" comprised an aqueous 5.25% NaOCl and 0.65% NaOH solution.

Ex. 2. Effect of Sequestering Agent Concentration on Whitening Ability

Cotton swatches were washed in wash liquors each containing a different amount of the sequestering agent. Specifically, Bleach Product A (5.25% NaOCl) was formulated to contain varying amounts (0% to 2.0%) of the polyacrylate. Each formulation was added to the washer at the presoak cycle. The results are shown in FIG. 1 which is a graph of number of least significant difference ("LSD") units from unwashed cotton (ΔW) vs. the weight percent of active polymer added to Bleach Product A. As a comparison, the same wash using Bleach Product A, produced ΔLSD value of 0.53 when the water contained no Fe or Mn ions and no soil. The results suggest that hypochlorite bleach formulations containing about 0.02% sequestering agent produced good whitening enhancement when both soil and Fe and Mn metal ions are present. However, above about 0.02% there is not a significant improvement in whitening whereas below about 0.02% there is a significant reduction.

Ex. 3. Effect of Sequestering Agent on Whitening Ability

Figure 2:
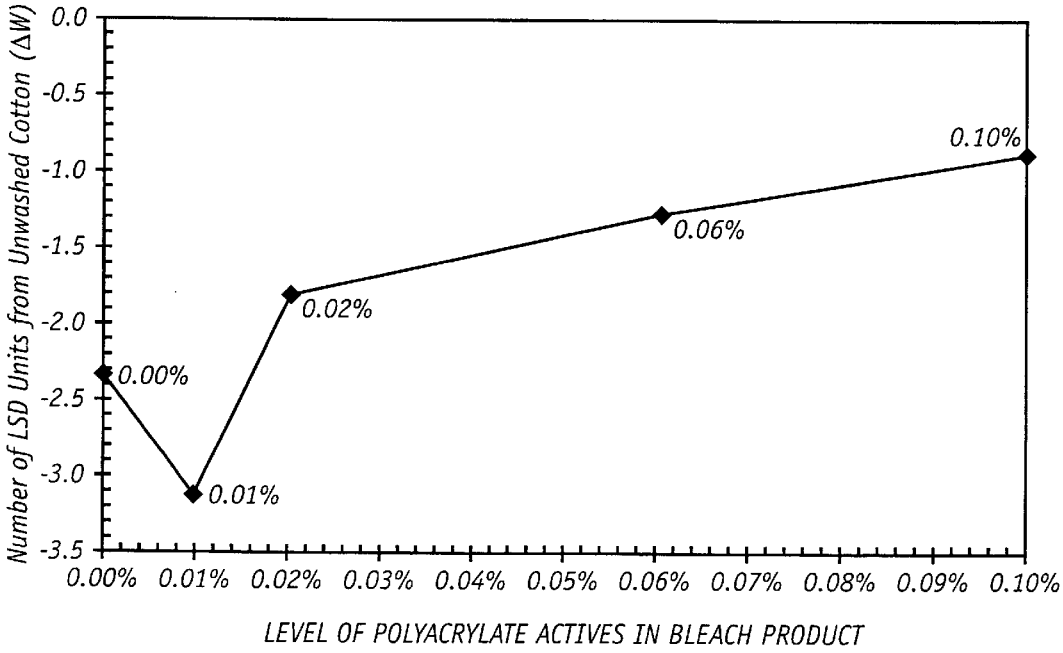

Essentially the same experiment as in Example 2 was conducted except that the weight percent of active polymer added ranged from 0.0% to 0.10%. Sufficient amounts of samples were used in order to bring the available chlorine level up to 200 ppm. The results are shown in FIG. 2 which is a graph of number of LSD units from unwashed cotton (ΔW) vs. the weight percent of active polymer added to Bleach Product A. As a comparison, the same wash using Bleach Product A produced ΔLSD value of 0.52, when the water contained no Fe or Mn ions and no soil. The results confirm that when the wash liquor contains significant levels of Fe (III) and Mn(II) ions, hypochlorite bleach formulations containing about 0.02% sequestering metal is preferred to produce good whitening enhancement.

Ex. 4. Effect of Soil on Sequestering Agent Performance

Figure 3:
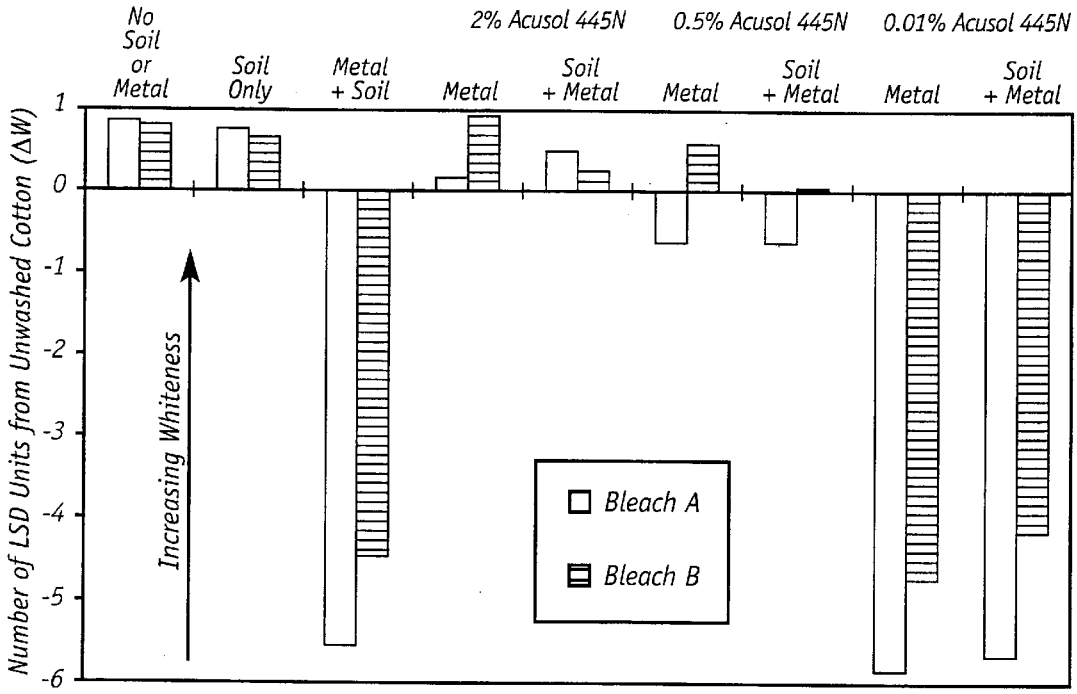
FIG. 3 is a graph showing the effect of soil on the performance of polyacrylate on yellowing of cotton fabric by metal-hypochlorite washes.

Cotton swatches were washed in wash liquors each comprising Bleach Products A or B, each containing varying amounts of the polyacrylate sequestering agent. Further each wash liquor comprised (1) metal ions, (2) soil, or (3) both metal ions and soil. The results are shown in FIG. 3 which is a graph of number of LSD units from unwashed cotton (ΔW) for the different wash liquor compositions. The results suggest that the extra sodium hydroxide in Bleach Product B (5.25% NaOCl and 0.65% NaOH) appears to provide a small (i.e., consistently present, but not always statistically significant) increase in the whitening performance at low polycarboxylate polymer concentrations. The hydroxide may neutralize some additional carboxylic acid sites on the polymer thereby providing more metal binding sites. In addition, in conjunction with FIG. 1, the data suggest that if 0.02% polycarboxylate is used, the presence of soil in the wash has little effect on the whitening performance of polymers in metal ion containing hypochlorite washes.

Examples 5 and 6

For Examples 5 and 6, cotton swatches were washed in a TERG-O-TOMETER for 20 minutes in 100° F. (37.8° C.) water with the baseline hardness and bicarbonate levels with no detergent present. The amount of each Bleach Product used provided 200 ppm available chlorine. All samples were rinsed in room temperature water and then dried for 30 minutes in a dryer. Metals levels were 900 ppb Fe(III) and 300 ppb Mn(II). No soil was added. Whiteness was determined by making pre-wash and post-wash reflectance measurements on a Hunter Colorimeter without a uv filter. In each case, the ΔW and number of LSD units from unwashed cotton were measured.

Ex. 5. Effect of Polycarboxylate Molecular Weight on Whitening Ability

Figure 4:
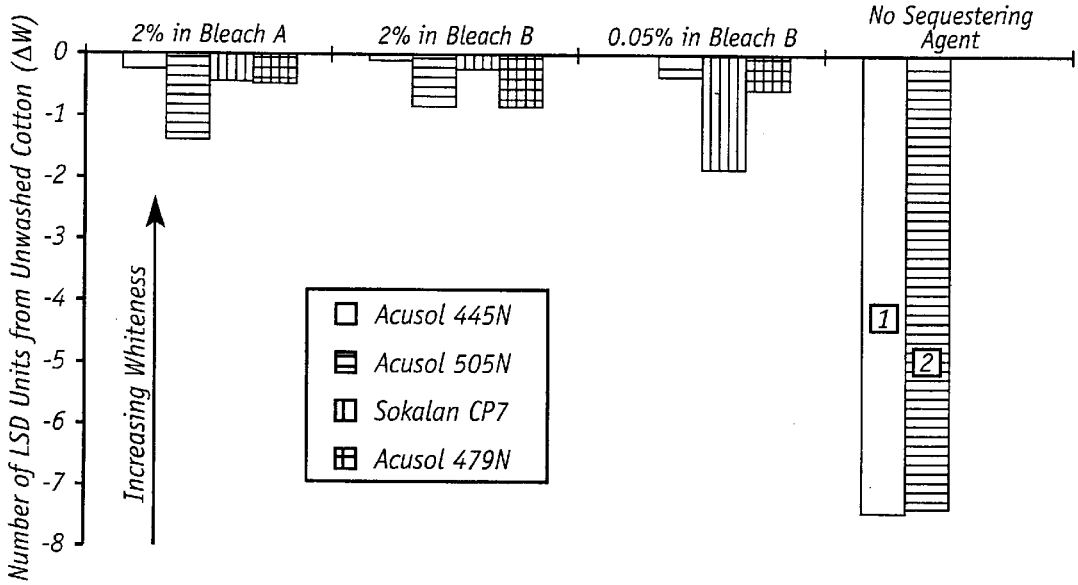
FIG. 4 is a graph showing the effect of polycarboxylate molecular weight on the yellowing of cotton fabric by hypochlorite-metal washes.

Cotton swatches were washed in wash liquors each comprising Bleach Product A or B and each containing either 0.05% or 2% of a sequestering agent selected from ACUSOL 445N™, polyacrylic acid, Na salt (MW 4,500), ACUSOL 479N ™, acrylic acid/maleic acid copolymer, Na salt (MW 70,000), ACUSOL 505N ™, acrylic acid/maleic acid copolymer, Na salt (MW 40,000) and SOKALAN CP7™, acrylic acid/maleic acid copolymer, Na salt (MW 50,000). The results are shown in FIG. 4 which is a graph of number of LSD units from unwashed cotton (ΔW) for the different wash liquor compositions. As a comparison, cotton swatches were also washed using Bleach Product A or B with no sequestering agents and the data are labeled as bars 1 and 2, respectively, in FIG. 4. The results suggest that variation of polymer chain length between 4.5 k to 70 k daltons has little effect on performance, and that substitution of another sequesterant of differing claim length should produce substantially equally good results.

Ex. 6. Effect of Hardness on Sequestering Agent Performance

Figure 5:
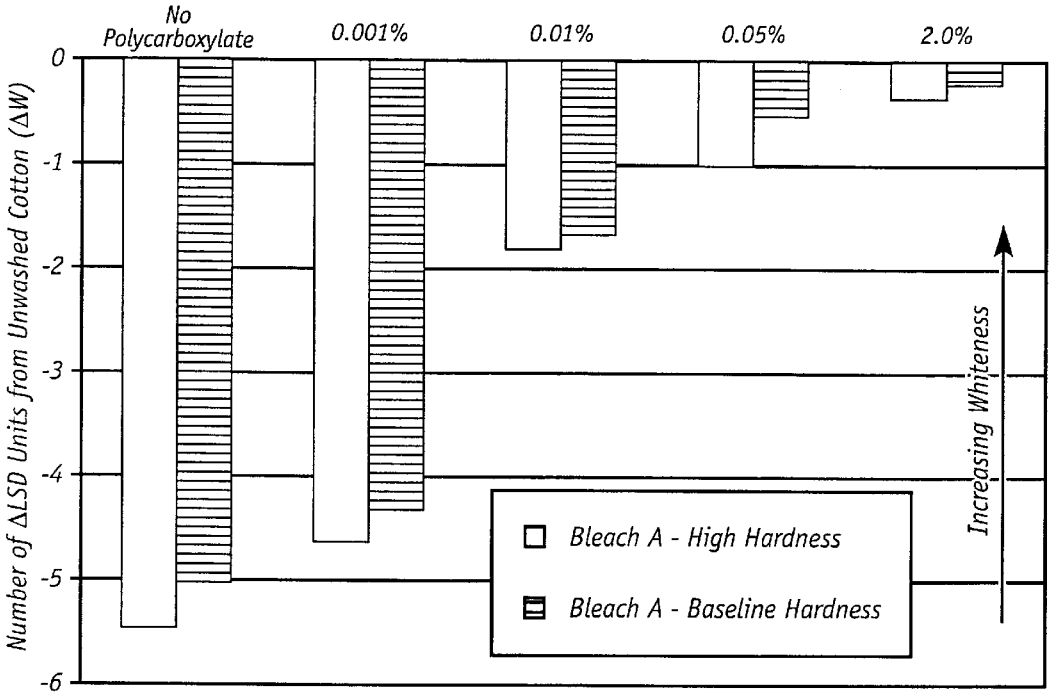
FIG. 5 is a graph showing the effect of hardness on the performance of polyacrylate in hypochlorite metal washes.

Cotton swatches were washed in wash liquors each comprising Bleach Product A and having baseline or high hardness and either 0.0%, 0.001%, 0.01%, 0.05%, or 2% of a sequestering agent, ACUSOL 445N™. High hardness is 250 ppm of 2:1 (Ca:Mg) hardness and 3.0 mM bicarbonate. Baseline hardness is 100 ppm of 3:1 (Ca:Mg) hardness and 1.5 mM bicarbonate. The results are shown in FIG. 5 which is a graph of number of LSD units from unwashed cotton (ΔW) for the different wash liquor compositions. The results demonstrate that hardness does not effect polyacrylate performance in metal-hypochlorite washes.

Ex. 7. Effect of Sequestering Agent on Different Fabric Materials

Cotton, polycotton, polyester, and nylon swatches were washed in wash liquor comprising: (i) different Mn and Fe ion levels, (ii) Bleach Product A(5.25% NaOCl solution), and (iii) presence (PC) and absence (no PC) of a 0.01 w/w % of a sequestering agent, namely, ACUSOL 445N ™, polyacrylic acid, Na salt (MW 4,500) in said Bleach Product. The swatches were washed in a TERG-O-TOMETER for 20 minutes in 100° F. (37.8° C.) water with standard hardness and bicarbonate levels with no detergent present. The amount of each bleach product used provided 200 ppm available chlorine. All samples were rinsed under room temperature water and then dried for 30 minutes in a dryer. No soil was added. Whiteness was determined by making pre-wash and post-wash reflectance measurements on a Hunter Colorimeter without a uv filter. In each case, the ΔW and number of LSD units from unwashed cotton were measured and calculated. The results are shown in Table 3 which indicate for each wash the number of ΔW units from unwashed cotton (ΔW) for the different wash liquor compositions and the calculated LSD for each fabric. Δ is the difference between $\Delta W_{PC}$ and $\Delta W_{NoPC}$.

TABLE 3

| | Cotton | | | Polycotton | | | Polyester | | | Nylon | | |
|---|---|---|---|---|---|---|---|---|---|---|---|---|
| Metal ions | NoPC | PC | Δ | NoPC | PC | Δ | NoPC | PC | Δ | NoPC | PC | Δ |
| 40 ppb Mn, 120 ppb Fe | −1.2 | 0.9 | 2.1 | −1.1 | 1.0 | 2.1 | −1.4 | 0.5 | 1.9 | −0.3 | 0.2 | 0.6 |
| 20 ppb Mn, 60 ppb Fe | −0.6 | 1.1 | 1.7 | −0.4 | 1.4 | 1.9 | −0.9 | 0.2 | 1.1 | −0.3 | 0.5 | 0.8 |
| 40 ppb Mn | 0.1 | 1.3 | 1.2 | −0.4 | 1.1 | 1.6 | −1.0 | 1.0 | 2.0 | −0.7 | 0.4 | 1.1 |
| No metals added | 0.8 | 1.4 | 0.6 | 0.0 | 0.9 | 0.9 | 0.2 | 0.4 | 0.3 | −0.2 | 0.6 | 0.8 |
| | | LSD | 1.6 | | LSD | 1.1 | | LSD | 1.2 | | LSD | 0.6 |

The data demonstrate that yellowing of fabric is appreciable when the level of iron ions is about 60 ppb in the wash liquor or when the manganese ions is about 20 ppb and that a polycarboxylate hypochlorite formulation can provide improved whitening at these metal levels.

Examples 8 and 7

To demonstrate that the polycarboxylate sequestering agents remain efficacious with age, hypochlorite-polyacrylate formulations were prepared and then aged for over 29 days at 120° F. (48.9° C.). (This is equivalent to aging for approximately 11 months at 70° F. (21° C.)). The formulations comprised aqueous 5.25% NaOCl solutions available as CLOROX® LIQUID BLEACH™ that further included 0.15% NaOH, and either 0.02%, 0.05%, or 0.1% of a sodium salt of polyacrylic acid that is available as ACUSOL 445N™ (MW 4,500). Fresh, non-aged, comparative aqueous 5.25% NaOCl solutions containing 0.15% NaOH and either 0.02%, 0.05%, or 2.0% polyacrylic acid were also prepared.

Cotton swatches were washed in a TERG-O-TOMETER for 20 minutes in 100° F. (37.8° C.) water with the baseline hardness and bicarbonate levels with no detergent present. The amount of each formulation used provided 200 ppm available chlorine. All samples were rinsed in room temperature tap water for at least 2 minutes and before being dried for 30 minutes in a dryer. Metals levels were 900 ppb Fe(III) and 300 ppb Mn(II). Whiteness was determined by making pre-wash and post-wash reflectance measurements on a Hunter Colorimeter without a uv filter.

Figure 6:
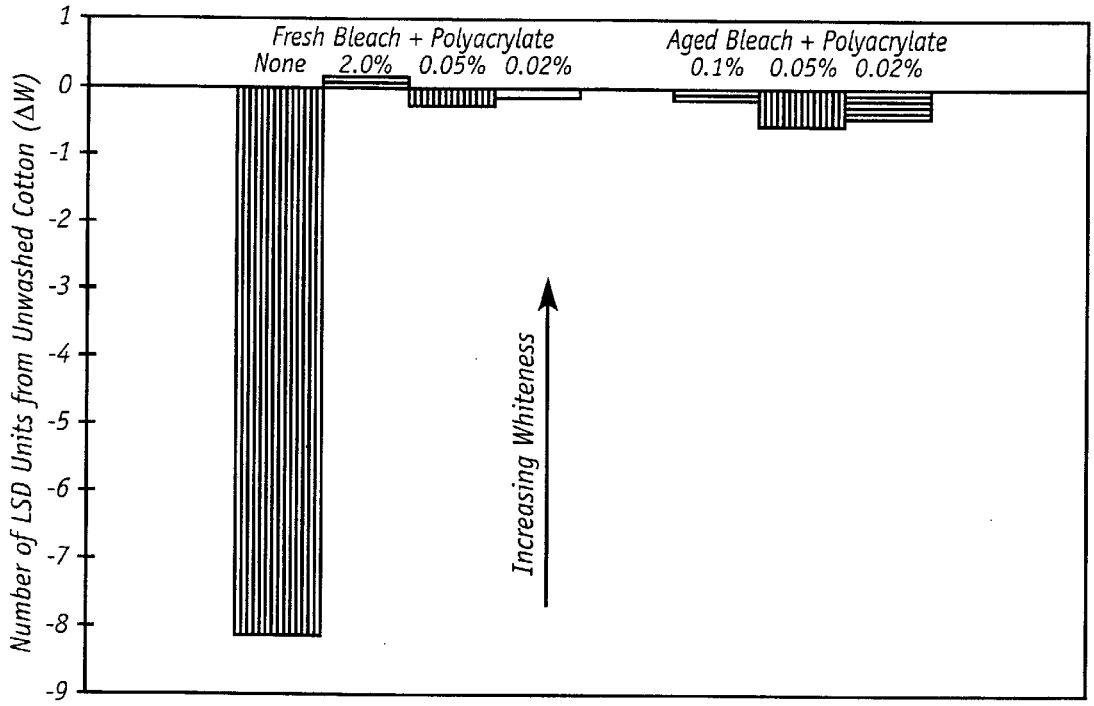
FIG. 6 is a graph showing the efficacy of aged polyacrylate-hypochlorite bleach compositions.

The results are shown in FIG. 6. As is apparent, the inventive hypochlorite-polyacrylate formulations are not adversely affected by aging. The whiteness observed after washing cotton fabric with the aged hypochlorite-polyacrylate in a wash liquor containing iron and manganese ions is nearly but identical (i.e., no statistical difference) to fabric washed under identical conditions using fresh hypochlorite-polyacrylate formulations.

To demonstrate the stability of hypochlorite in the presence of the polycarboxylate sequestering agents, hypochlorite-polyacrylate formulations were prepared and then aged for over 14 days at 120° F. (This is equivalent to aging for approximately 11 months at 70° F.) (21° C.). The formulations comprised aqueous 5.25% NaOCl solutions available as CLOROX® LIQUID BLEACH™ that further included 0.15% NaOH and 0.1% of ACUSOL 445N™.

Figure 7:
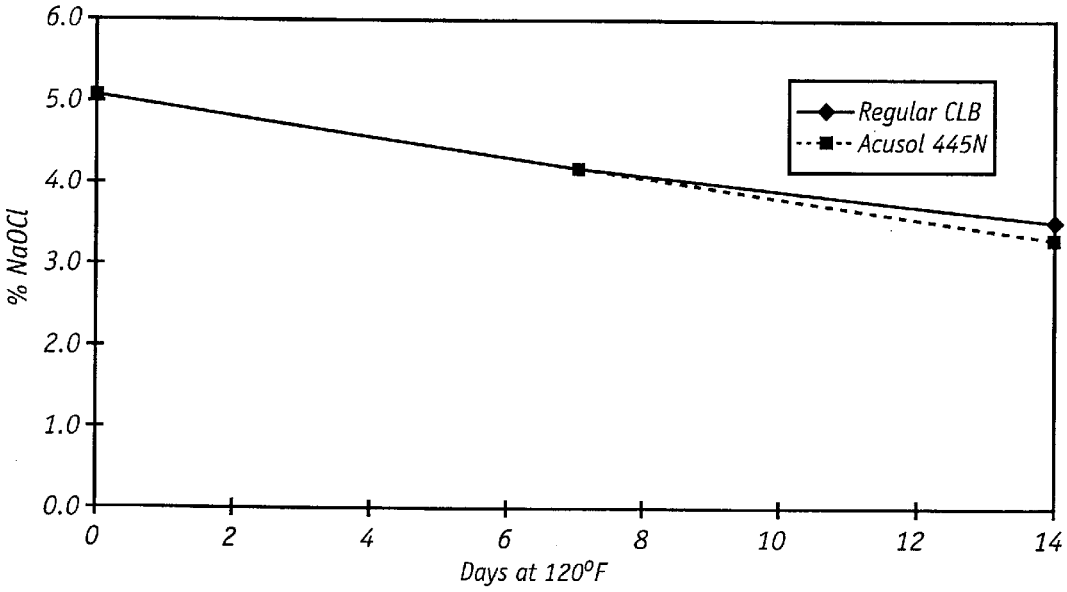
FIG. 7 is a graph showing the stability of the hypochlorite bleaching composition in the presence of polycarboxylate.

The amount of hypochlorite present in the samples was determined by titration at 7 and 14 days during the aging process. The results are shown in FIG. 7 and they indicate that for the aqueous bleach composition containing the polycarboxylate sequestering agent, the NaOCl level remained essentially the same throughout the aging process.

It is expected that the aqueous hypochlorite bleach compositions of the present invention will remain stable for at least 12 months or longer when stored at about 70° F. By stable is meant that the amount of the alkali metal hypochlorite remaining in the composition preferably will be at least about 90%, and more preferably at least about 95% of the original amount when first formulated. Typically, the amount of alkali metal hypochlorite remaining will range from about 90% to about 95% of the original concentration.

Although only preferred embodiments of the invention are specifically disclosed and described above, it will be appreciated that many modifications and variations of the present invention are possible in light of the above teachings and within the purview of the appended claims without departing from the spirit and intended scope of the invention.

What is claimed is:

1. A method for laundering fabrics with improved whitening and reduced fabric damage, said method comprising:

a) providing, in a wash liquor conning (i) at least about 40 ppb of iron cations or (ii) at least about 10 ppb of manganese cations, or (iii) the cations of both (i) and (ii), and at least one fabric piece; and b) adding prior to, contemporaneously with, or after, the step of providing said fabric piece to said wash liquor a liquid aqueous hypochlorite composition which comprises from about 4 to 15% by weight of an alkali metal hypochlorite and an effective amount of a non-crosslinked polyacrylic acid polymer or a copolymer of acrylic acid and maleic acid, said polymer or copolymer having a molecular weight of about 1,000 to about 70,000 daltons to mitigate the attack of said cations on said fabric; said hypochlorite composition further comprising an effective amount of buffer to achieve a pH of the composition of greater than about 10.

2. The method of claim 1 wherein the polymer or copolymer comprises at least 0.1 ppm by weight of said wash liquor.

3. The method of claim 1 wherein said polymer or copolynmer comprises from about 0.0015% to about 5% of said hypochlorite composition.

4. The method of claim 1 wherein said fabric piece is manufactured from cotton, polycotton, polyester, nylon materials and combinations thereof.

5. The method of claim 1 wherein said hypochlorite composition additionally comprises at least one additional adjunct selected from the group consisting of buffers, builders, fluorescent whitening agents, pigments, dyes and thickening agents.

6. The method of claim 1 wherein said hypochlorite composition further comprises a surfactant.

7. The method of claim 1 wherein the wash liquor does not include a laundry detergent.

8. The method of claim 1 wherein the said alkali metal hypochlorite is sodium hypochlorite which comprises about 4% to 8% of said composition.

9. A wash liquor containing (i) at least about 40 ppb of iron cations or (ii) at least about 10 ppb of manganese cations, or (iii) the cations of both (i) and (ii), and said wash liquor farther comprising:

a) at east one fabric piece which has a tendency to be attacked by said cations In said wash liquor; and b) a liquid hypochlorite composition which includes from about 4 to 15% by weight of an alkali metal hypochlorite and an effective amount of a non-crosslinked polyacrylic acid polymer or a copolymer of acrylic acid and maleic acid, said polymer or copolymer having a molecular weight of about 1,000 to about 70,000 daltons to mitigate the attack of said cations on said fabric piece; said hypochlorite composition further comprising an effective amount of buffer to achieve a pH of the composition of greater than about 10.

10. The wash liquor of claim 9 wherein the polymer or copolymer comprises at least 0.1 ppm by weight of said wash liquor.

11. The wash liquor of claim 9 wherein said fabric piece is manufactured from cotton, polycotton, polyester, nylon materials and combinations thereof.

12. The wash liquor of claim 9 wherein said polymer or copolymer comprises from about 0.0015% to about 5% of said hypochlorite composite.

13. The wash liquor of claim 9 wherein said hypochlorite composition additionally comprises at least one additional adjunct selected from the group consisting of buffers, builders, fluorescent whitening agents, pigments, dyes and thickening agents.

14. The wash liquor of claim 9 wherein said hypochlorite composition further comprises a surfactant.

15. The wash liquor of claim 9 wherein said wash liquor does not include a laundry detergent.

16. The wash liquor of claim 9 wherein said alkali metal hypochlorite is sodium hypochlorite which comprises about 4% to 8% of said composition.

* * * * *